US005485784A

United States Patent [19]

Walschlaeger, Sr.

[11] Patent Number: 5,485,784

[45] Date of Patent: Jan. 23, 1996

[54] PRINTING PLATE CYLINDER WITH UNIVERSAL LOCKUP APPARATUS

[76] Inventor: Alan R. Walschlaeger, Sr., 1334 S. Hamilton, Elmhurst, Ill. 60126

[21] Appl. No.: 267,859

[22] Filed: Jun. 28, 1994

[51] Int. Cl.[6] ..... B41F 1/28

[52] U.S. Cl. ..... 101/415.1

[58] Field of Search ..... 101/415.1, 378, 101/382

[56] References Cited

U.S. PATENT DOCUMENTS

| | | | |
|---|---|---|---|
| 2,050,950 | 8/1936 | Huck | 101/415.1 |
| 2,764,089 | 9/1956 | Bachman | 101/415.1 |
| 4,277,164 | 7/1981 | Fortmann | 101/415.1 |
| 4,493,258 | 1/1985 | Wallschlaeger et al. | 101/415.1 |
| 5,010,818 | 4/1991 | Wallschaeger, Sr. | 101/415.1 |
| 5,012,738 | 5/1991 | Bloothoofd | 101/415.1 |
| 5,062,363 | 11/1991 | Reichel | 101/415.1 |
| 5,131,327 | 7/1992 | Nagasono et al. | 101/415.1 |
| 5,325,778 | 7/1994 | Hartung et al. | 101/415.1 |

FOREIGN PATENT DOCUMENTS

| | | | |
|---|---|---|---|
| 593229 | 8/1925 | France | 101/415.1 |
| 1248062 | 8/1967 | Germany | 101/415.1 |
| 1556389 | 11/1979 | United Kingdom | 101/415.1 |

*Primary Examiner*—Eugene H. Eickholt

[57] ABSTRACT

A printing plate cylinder (10) having an elongate mounting slot (12) with a pair of opposite walls (14A, 14B), with a universal lockup apparatus (16) for releasibly holding the opposed edges (42A, 42B) of a printing plate (44) within the mounting slot (12), the universal lockup apparatus (16) having a roller member (18) for clamping at least one of the opposed edges (42A, 42B) of the plate (44) against one of the opposed walls (14A, 14B) of the slot (12), a brace member (20) mounted to securement pivot posts (22) for movement about roller member (18) between one operative position in which the brace member (20) is interposed between one of the pair of opposite walls (14A) of the slot (12) and the clamping roller member (18) to brace the clamping member (18) against movement away from the other one of the pair of opposite walls (14B) to another operative position in which the brace member (20) is interposed between the other one of the pair of opposite walls (14B) of the slot (12) and the clamping member (18) to brace the clamping member (18) against movement away from the one of the pair of opposite walls (14A).

20 Claims, 3 Drawing Sheets

PRINTING PLATE CYLINDER WITH UNIVERSAL LOCKUP APPARATUS

BACKGROUND OF THE INVENTION

1. Field of the Invention

This invention relates generally to the field of offset lithographic printing presses and more particularly to a lockup apparatus for holding a printing plate on the surface of a printing plate cylinder.

2. Description of the Related Art Including Information Disclosed under 37 C.F.R. Section 1.97–1.99

In offset lithographic printing presses a thin flexible printing plate carrying a planographic image is releasibly held on the surface of a plate cylinder. To achieve optimal printing quality it is crucial that the printing plate conform to the surface of the plate cylinder. Securement of the printing plate to known plate cylinders is performed by providing a longitudinal mounting slot in the plate cylinder and inserting an edge of the printing plate therein. The printing plate edge is releasibly held within the slot by a lockup holding device.

In U.S. Pat. No. 5,010,818 to Wallschlaeger, a tensionless plate lockup apparatus having a locking element with a curved surface contacts the ends of a printing plate thereby clamping the ends against a slot surface in the printing plate cylinder. A plurality of locking elements are disposed at predetermined intervals along the length of the slot in the printing plate. A spacer bar having a plurality of upwardly extending mounting posts is placed within the slot to maintain each locking element in a fixed position. The lockup apparatus is configured to secure the edges of the printing plate against a surface of the slot for rotation of the plate cylinder in either a clockwise or counterclockwise direction. However, to accomplish this, the slot width must be very narrow to facilitate the clamping member to contact the clamping surfaces on both sides of the slot. In order to contact both biased surfaces simultaneously the force of the spring and the centrifugal force acting on the clamping member must be shared equally between the two biased surfaces such that the force acting to clamp the printing plate is reduced by the amount of force wasted on the unused biased surface.

Disadvantageously, in this embodiment the fixed securement of the locking elements onto the mounting posts of the spacer bar does not permit pivotal movement of the mounting posts. Furthermore, the mounting arrangement of the locking elements on the spacer bar creates lateral translational movement of the mounting posts upon insertion to the slot of the plate cylinder. Additionally, the rigid engagement of the stationary locking element establishes lateral frictional forces against the slot surface thereby creating an uneven wear of the locking element.

In an alternative embodiment shown in U.S. Pat. No. 5,010,818, the printing plate is tightly secured to the cylinder body in order to reduce plate cracking. However, in this embodiment dedicated cylinder rotation is required in either a clockwise or counterclockwise direction. Therefore, this alternative design cannot be universally used in a press configuration where select cylinders are required to operate in a reverse direction for different print layouts.

In U.S. Pat. No. 4,493,258 to Wallschlaeger et al. a plate lockup mechanism has an elongated cam with an arcuate surface and a generally V-shaped removed portion which rotates on the bottom surface of a plate roll groove. A bar-like toggle having arcuate lower surfaces is mounted on the arcuate outer surface of the cam. A securing member carried on the toggle engages the edge of a printing plate fixedly holding the plate edge. The leading edge of the plate is held against the clamping surface of the slot by a fixed spring. The trailing edge of the plate is held in tension by a toggle mounted spring in contact with the plate edge. The toggle is positioned by activating the cam in which the radius of the cam interfaces with a radius on the lower portion of the toggle causing the toggle to rotate and tension the spring on the plate edge.

Disadvantageously, the trailing edge of the plate is positioned by the spring making the location lockup dependent, thus allowing for a poor fit between the plate and the cylinder body. Additionally, when the plate is held by tension, the plate is more susceptible to circumferential slippage resulting in poor registration and plate cracking. Friction between the rigid securing members and the plate edge also creates lateral tangential sheering forces upon the high speed rotation of the cylinder.

SUMMARY OF THE INVENTION

It is therefore a principal object of the present invention to provide a universal lockup apparatus releasibly holding opposed edges of a printing plate within an elongate mounting slot of a printing plate cylinder in which the disadvantages of known lockup mechanisms noted above are overcome.

The object is achieved in part by providing a printing plate cylinder having an elongate mounting slot with a pair of opposite walls with a universal lockup apparatus for releasibly holding opposed edges of a printing plate within the mounting slot, comprising a member for clamping at least one of the opposed edges of the plate against a wall of the slot, a brace member, means for mounting the brace member for movement between one operative position in which it is interposed between one of the pair of opposite walls of the slot and the clamping member to brace the clamping member against movement away from the other one of the pair of opposite walls to another operative position in which the brace member is interposed between the other one of the pair of opposite walls of the slot and the clamping member to brace the clamping member against movement away from the one of the pair of opposite walls.

The object is also achieved by providing in a printing plate cylinder having an elongate mounting slot with a pair of opposite walls a universal lockup apparatus for releasibly holding the edges of a printing plate within the mounting slot, comprising a member for clamping at least one of the edges against one of the pair of opposite walls of the mounting slot, a post with one end for carrying the clamping member and another end, means for mounting the other end of the post for relative pivotal movement of the post between two opposed positions in which the clamping member is in clamping engagement with a selected one of the pair of opposite walls of the slot, respectively, and spaced from the other one of the pair of opposite walls.

The object is further achieved in part by providing a printing plate cylinder having an elongate mounting slot with a pair of opposite walls, a universal lockup apparatus for releasibly holding opposed edges of a printing plate within the mounting slot, comprising a member for clamping at least one of the edges against one of the pair of walls of the slot and means for movably mounting the clamping member for rotation about a preselected axis.

BRIEF DESCRIPTION OF THE DRAWINGS

The foregoing objects and advantageous feature of the invention will be explained in greater detail and others will be made apparent from the detailed description of the preferred embodiment of the present invention which is given with reference to the several figures of the drawing, in which.

DESCRIPTION OF PREFERRED EMBODIMENT

Figure 1:
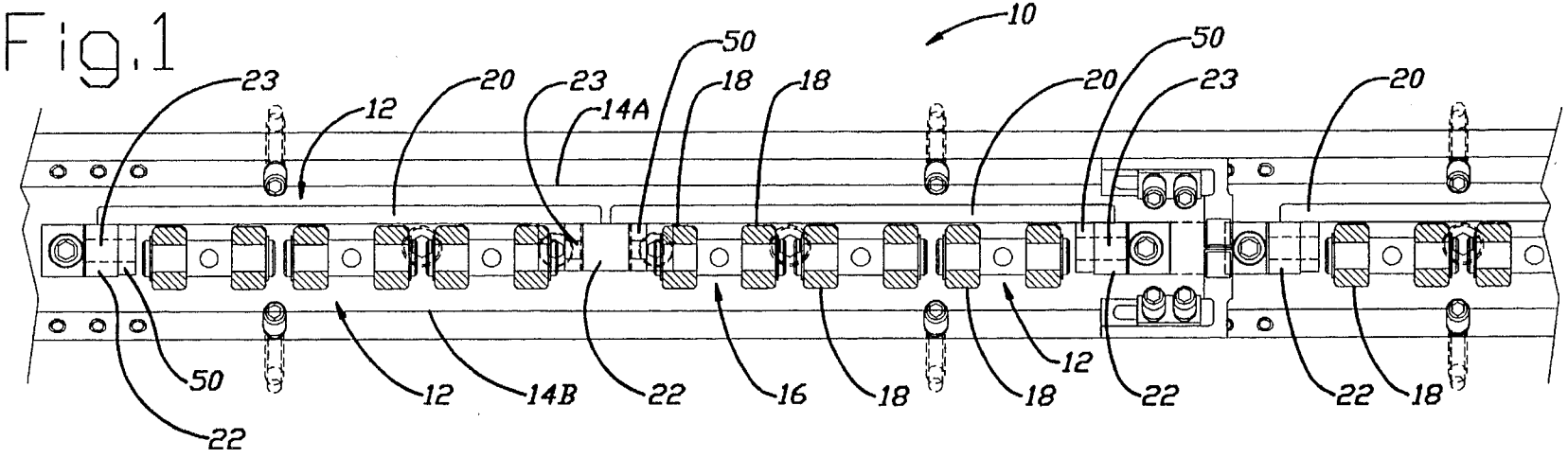
FIG. 1 is a partial plan elevation view of the universal lockup apparatus.

Referring to FIG. 1, a top view of printing plate cylinder 10 is shown having an exposed elongate mounting slot 12 with a pair of opposed slot walls 14A and 14B. A universal lockup apparatus 16 is disposed within the elongate mounting slot 12 of the plate cylinder 10 for releasibly holding opposed edges of a printing plate against one of the opposite lot walls of the slot. The universal apparatus of the lockup apparatus 16 clamping the edges of a printing plate within the slot is shown in detail with reference to FIGS. 3A and 3B.

Roller members 18 are employed to resiliently clamp the opposed edges of a printing plate against one of the opposed slot walls 14A and 14B. The universal lockup apparatus 16 includes brace members 20 mounted to securement pivot posts 22 to enable movement of the brace members along roller clamping members 18 to different operative positions which correspond to the direction of rotation of the printing plate cylinder 10. Pins 23 are slotted through pivot posts 22 to secure the brace members 20 to the pivot posts and to allow the brace members to freely rotate about the perimeter of the roller members 18.

Figure 2:
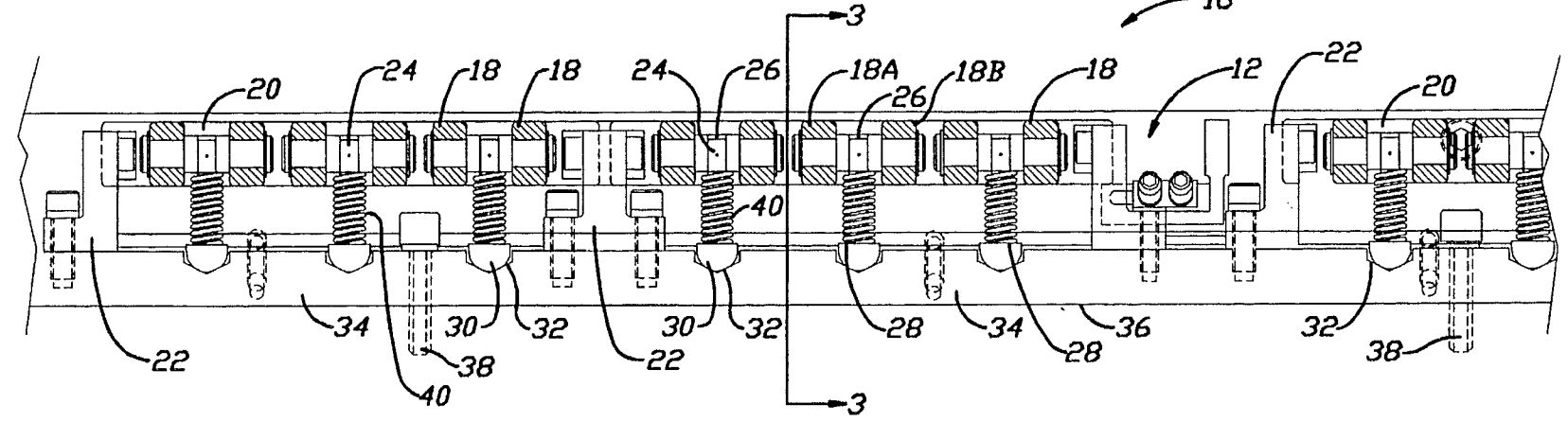
FIG. 2 is a partial side view of the universal lockup apparatus of FIG. 1.

Referring now to FIG. 2, a side view of the universal lockup apparatus 16 illustrates a pair of clamping members 18A and 18B secured to post 24. The elongate brace members 20 are held by pins 23, FIG. 1, to securement pivot posts 22, FIG. 2, which provide pivotal movement of the brace member. The brace member 20 has sufficient length to concurrently engage one clamping roller member 18A and another clamping member 18B held by a single support post 24. Preferably, a single brace member 20 engages six clamping members 18 held in the slot 12 by three support posts 24.

The support post 24 has a top end 26 for carrying a pair of clamping roller members 18. The bottom end 28 of the post 24 has a mounted ball-like member 30 secured to a socket 32 carried by an elongate locator bar 34 releasibly secured to the bottom surface 36 of the slot 12 by screws 38. The elongate locator bar 34 has a plurality of sockets 32 positioned at preselected locations along slot 12. The ball members 30 secured to the bottom end 28 of post 24 and mounted within the sockets 32 of the elongate locator bar 34 enables universal pivotal movement of the lockup apparatus 16. The arrangement of the ball members 30 positioned against the sockets 32 of the locator bar 34 fixedly secured to the bottom surface 36 of slot 12 restrains the bottom end 28 of post 24 from lateral translational movement along the slot. Spring 40 is secured around the post 24 to provide a biasing force against the roller members 18 toward clamping engagement with a selected side of the slot 12 and the brace member 20.

Figure 3A:
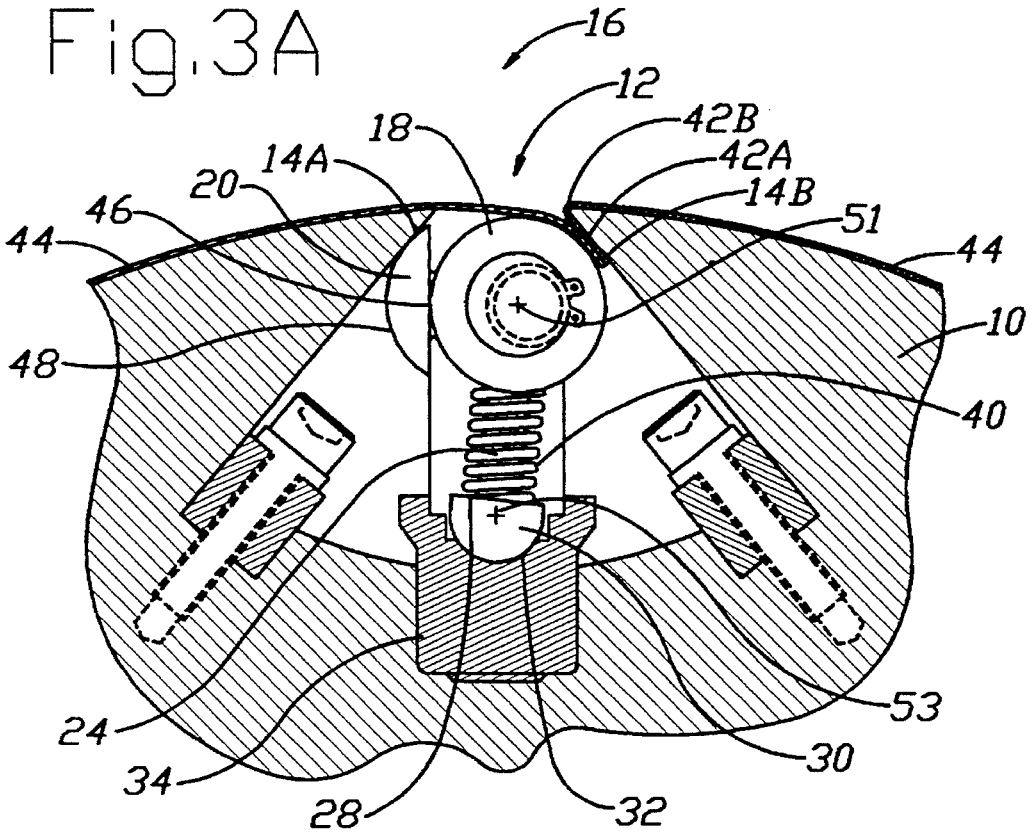
FIG. 3A is a cross-sectional view of the universal lockup apparatus taken along line 3—3 of FIG. 2 illustrating one operative position of the lockup apparatus holding the edges of a printing plate.

Referring now to FIG. 3A, the universal lockup apparatus 16 is shown in an operative position with the opposed edges 42A, 42B of printing plate 44 releasibly held in the slot 12 of the printing plate cylinder 10. The elongate mounting slot 12 has a pair of opposite walls 14A and 14B. Roller member 18 clamps the opposed edges 42A, 42B of the plate 44 against slot wall 14B. The brace member 20 is interposed between slot wall 14A and the clamping roller member 18 to brace the roller against movement away from opposing slot wall 14B. As shown in FIGS. 1 and 2, the brace member 20 concurrently engages a plurality of roller member 18, to secure the rollers and plate edges 42A, 42B, FIG. 3A, in a bracing relationship against slot wall 14B. Brace member 20, FIG. 3A, has a nonarcuate surface 46 engaging the surface of the roller clamping member 18 and a convex arcuate surface 48 adjacent the opposed slot wall 14A. The nonarcurate surface 46 of the member 20 is engaged against and restrained by the securement pivot posts 22 when in an operative position to securely brace the rollers 18.

Referring again to FIG. 1, end pieces 50 of brace member 20 are mounted to securement pivot posts 22 by pegs or pins 23 bored through the securement posts to provide arcuate movement of the brace member over roller 18 between the opposed side walls 14A and 14B of the elongate slot 12. Spring 40, Fig. 3A, mounted to support post 24 provides a biasing force against the roller 18 toward clamping engagement with opposed slot wall 14B. Spring 40 also provides a biasing force toward bracing engagement with the brace member 20.

Figure 3B:
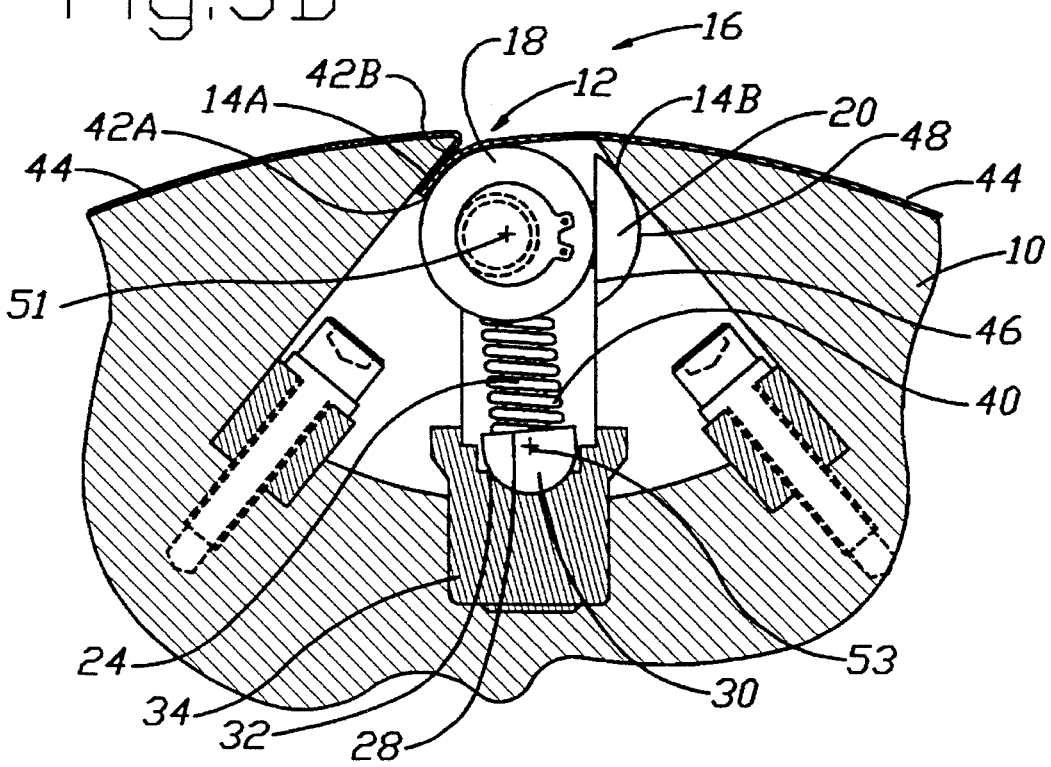
FIG. 3B is a cross-sectional view showing the universal lockup apparatus in an alternative operative position for holding the edges of a printing plate.

Referring now to FIG. 3B, the universal lockup apparatus 16 is shown in an alternative operative position in which the bail-like brace member 20 is interposed between opposed wall 14B of the slot 12 and the clamping member 18. The elongate bail-like member 20 braces clamping member 18 against movement away from opposed slot wall 14A. In the alternative position clamping roller 18 secures the edges 42A and 42B of the printing plate 44 against slot wall 14A. The lockup apparatus 16, as seen in FIGS. 3A and 3B, releasibly holds the printing plate edges 42A and 42B against slot walls 14A and 14B providing universal securement of the printing plate to enable rotation of the plate cylinder 10 in both a clockwise and a counter-clockwise direction. The operative position of the lockup assembly shown in FIG. 3A, is preferably employed when rotating the plate cylinder 10 in the counter-clockwise direction. Alternatively, the operative position of the lockup assembly of FIG. 3B is preferably employed for rotation of the plate cylinder 10 in the clockwise direction.

The non-arcuate surface 46 of the brace member 20 is mounted in abutting engagement with the operative rollers 18. To change the operative positioning of the lockup apparatus 16, the brace member 20 is moved by rolling the nonarcuate surface 46 over the clamping rollers 18 from abutment against one side of the securement pivot posts 22 until the nonarcuate surface 46 of the brace member engages the other side of the pivot post 22. Rollers 18 are thereby positioned to clamp the opposed printing plate edges 42A and 42B against the slot side wall 14A. The ball member 30 attached to the bottom end 28 of post 24 engaging the socket 32 of the locator bar 34 provides pivotal movement of the post 24 between the two opposed operative positions shown in FIGS. 3A and 3B. The rollers 18 are slightly moved downwardly in the slot 12 cavity as the brace member 20 is guided over the rollers between the operative positions. The spring 40 mounted to post 24 provides an upward force against a trunion upon which rollers 18 ride on for returning the downwardly depressed rollers 18 to a clamping operative position once movement of the brace member is complete. Both clamping rollers 18A and 18B, of FIG. 2, are mounted to its associated post 24 through the trunion which permits the rollers to turn upon insertion of the printing plate edges 42A, 42B. The turning of the rollers 18 allows the plate 44 to seek its own position within the slot and enables its own clamping position when the plate is locked.

Referring again to FIG. 3A, the clamping roller members 18 are movably mounted for rotation about a preselected center axis of symmetry 51. The supporting posts 24 each carry a pair of clamping roller members 18A, 18B, FIG. 2, in which both rollers are mounted for rotation about the preselected center axis of symmetry 51. Additionally, the post 24 supporting the clamping rollers 18 is pivotally mounted by means of the ball 30 and socket 32 arrangement. The center axis of symmetry 51 about which the rollers 18 are positioned for rotation is mounted to the post 24 carrying the ball member 30 in the socket 32 of the locator bar 34. The ball 30 and socket 32 arrangement. provides for pivotal movement of the center axis of symmetry 51 about another axis 53. As seen in FIG. 3A and 3B, the axis 53 for pivotal movement of the post 24 carrying the rollers 18 is spaced from the preselected axis of symmetry 51 of the rollers and is preferably located at the center of the hemispherical portion of the ball-like member 30 in the socket 32.

Figure 4A:
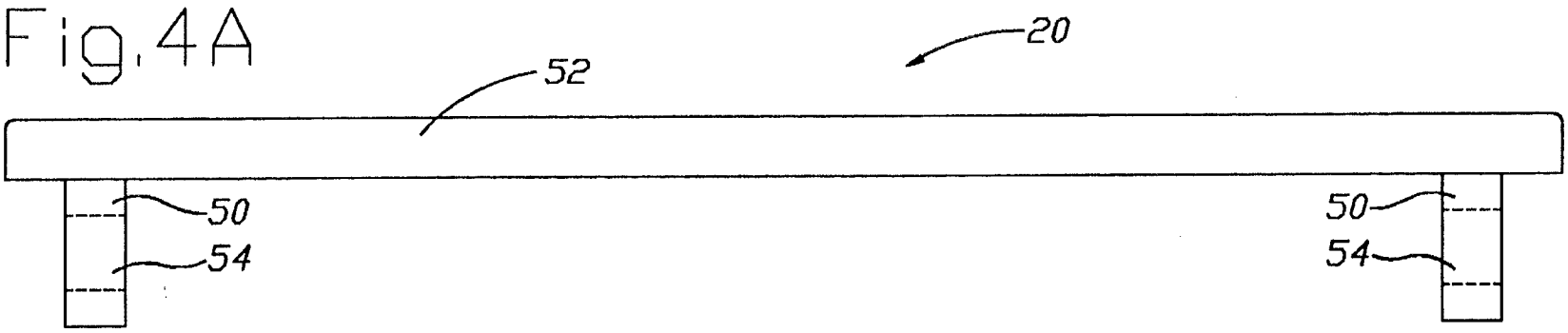
FIG. 4A is a plan view of a preferred brace member of the universal lockup apparatus of the present invention.

Referring now to FIG. 4A, brace member 20 is shown having elongate brace piece 52 connecting a pair of end pieces 50. End pieces 50 each have a bore 54 for receipt of pegs 23, FIG. 1, interconnected to securement posts 22 allowing the pivoting of the brace member 20 for movement about rollers 18 to change operative positioning.

Figure 4B:
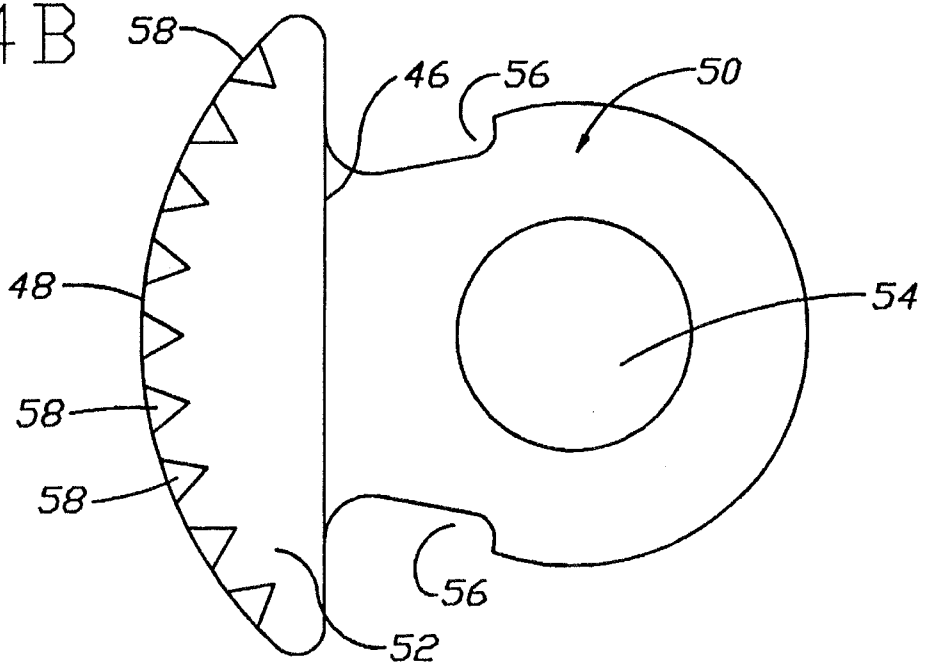
FIG. 4B is an end view of the preferred brace member of FIG. 4A.

Referring to FIG. 4B, the brace member end piece 50 is shown having a pair of fingerholds 56 to facilitate manual movement of the brace member 20 between the different operative positions. The fingerhold 56 is located for finger access when the brace member 20 is in either of the operative positions of FIG. 3A and 3B. To rotably move the brace member bail between operative positions, the press operator inserts a finger into the elongate slot 12, engages the fingerhold 56 facing upwardly in the slot and pulls back on the fingerhold to turn the brace member. The brace member 20 also has a plurality of other fingerholds 58 serrated at the end of the elongate brace piece 52. The other fingerholds 58 are accessible only when the brace member 20 is in a position intermediate the operative positions of FIGS. 3A and 3B. Fingerhold 56 is used initially to turn the brace member 20 and the other fingerholds 58 are subsequently employed in a similar manner to facilitate manual rotation of the brace member into an alternative operative position.

While a detailed description of the preferred embodiment of the invention has been given, it should be appreciated that many variations can be made thereto without departing from the scope of the invention as set forth in the appended claims.

I claim:

1. In a printing plate cylinder having an elongate mounting slot with a pair of opposite walls, the improvement being a universal lockup apparatus for releasibly holding opposed edges of a printing plate within the mounting slot, comprising:

a member for clamping at least one of the opposed edges of the plate against one of the opposed walls of the slot;

a brace member;

means for mounting the brace member for movement between one operative position in which it is interposed between one of the pair of opposite walls of the slot and the clamping member to brace the clamping member against movement away from the other one of the pair of opposite walls to another operative position in which the brace member is interposed between the other one of the pair of opposite walls of the slot and the clamping member to brace the clamping member against movement away from the one of the pair of opposite walls.

2. The universal lockup apparatus of claim 1 including at least another clamping member spaced from said one clamping member for clamping the at least one of the opposed edges of the plate against a selected one of the pair of opposite walls of the slot, and in which the brace member has a length sufficient to concurrently engage both of the one clamping member and the at least one other clamping member, and said brace member mounting means includes means for mounting the brace member for movement to engage both of the one and the other clamping members in bracing relationship.

3. The universal lockup apparatus of claim 1 in which the brace member includes a fingerhold connected with the brace member for facilitating manual movement of the brace member between said one and the other positions and being located for finger access when the brace member is in either of said one and the other operative positions.

4. The universal lockup apparatus of claim 3 including another fingerhold connected with the brace member for facilitating manual movement of the brace member between said one and the other portions, said other fingerhold being spaced from said one fingerhold and being accessible only when the brace member is intermediate said one and the other operative positions.

5. The universal lockup apparatus of claim 1 in which the brace member has a surface for engagement with a surface of the clamping member, and the brace member mounting means includes means for mounting the brace member in abutting engagement with the clamp member and including means for mounting the brace member for rolling movement with respect to the brace member engagement surface during movement of the brace member between the one and the other operative positions.

6. The universal lockup apparatus of claim 1 in which the brace member has a relatively convex arcuate surface adjacent the selected one of the pair of opposite walls of the slot when in one of said one and the other operative positions, and a relatively nonarcuate surface for engagement with the clamping member.

7. The universal lockup apparatus of claim 1 including means for mounting the brace member for arcuate movement between said pair of opposite walls in one direction in response to movement of the brace member between said pair of opposite walls in the direction opposite of said one direction.

8. The universal lockup apparatus of claim 1 including means for mounting the clamping member for movement toward the pair of opposite walls, and means for biasing the clamping member for movement toward the pair of opposite walls.

9. In a printing plate cylinder having an elongate mounting slot with a pair of opposite walls, the improvement being a universal lockup apparatus for releasibly holding the edges of a printing plate within the mounting slot, comprising:

a member for clamping at least one of the edges against one of the pair of opposite walls of the mounting slot;

a post with one end and means for carrying the clamping member and another end, means for mounting the other end of the post for relative pivotal movement of the post between two opposed positions in which the clamping member is in clamping engagement with a selected one of the pair of opposite walls of the slot, respectively, and spaces from the other one of the pair of opposite walls.

10. The universal lockup apparatus of claim 9 in which the pivotal movement mounting means includes means for mounting the other end of the post for relatively universal pivotal movement.

11. The universal lockup apparatus of claim 9 in which the pivotal movement mounting means includes a ball-like member mounted to the other and of the post, and means for carrying a socket for receipt of said ball-like member.

12. The universal lockup apparatus of claim 9 in which said pivotal movement mounting means includes means for restraining the one end of the post from lateral translational movement.

13. The universal lockup apparatus of claim 9 in which said carrying means includes an elongate locator bar with a plurality of sockets at preselected locations along the slot, and means for releasibly securing the locator bar in a bottom surface of the slot.

14. The universal lockup apparatus of claim 9 including a brace member, and means for mounting the brace member for movement between opposite sides of the clamping member.

15. The universal lockup apparatus of claim 14 including means for biasing the clamping member toward clamping engagement with the selected one of the pair of opposite sides of the slot and the brace member, said brace member being mounted for movement to positions interposed between the brace member and the other one of the side walls that is not selected for engagement with the clamping member.

16. In a printing plate cylinder having an elongate mounting slot with a pair of opposite walls, the improvement being a universal lockup apparatus for releasibly holding opposed edges of a printing plate within the mounting slot, comprising:

a member for clamping at least one of the edges against one of the pair of walls of the slot;

means for movably mounting the clamping member for rotation about a preselected axis for clamping at least one of the edges against the other one of said walls of the slot.

17. The universal lockup mechanism of claim 16 in which the clamping member includes a roller with a center axis of symmetry which coincides with the preselected axis.

18. The universal lockup mechanism of claim 16 in which the mounting means has means for mounting a second clamping member for rotation about said preselected axis.

19. The universal lockup mechanism of claim 16 including means for mounting the clamping member movably mounting means for pivotal movement about an axis spaced from the preselected axis.

20. The universal lockup mechanism of claim 16 including a brace member, and means for biasing the clamping member toward clamping engagement with one of the pair of opposite walls and toward bracing engagement with the brace member.

* * * * *